US012098552B2

(12) United States Patent
Johnson

(10) Patent No.: US 12,098,552 B2
(45) Date of Patent: Sep. 24, 2024

(54) POWER TOOL SYSTEM AND METHOD FOR REMOVING ROOF SHINGLES

(71) Applicant: Thomas Merle Johnson, Cedar Falls, IA (US)

(72) Inventor: Thomas Merle Johnson, Cedar Falls, IA (US)

( * ) Notice: Subject to any disclaimer, the term of this patent is extended or adjusted under 35 U.S.C. 154(b) by 0 days.

(21) Appl. No.: 17/856,518

(22) Filed: Jul. 1, 2022

(65) Prior Publication Data

US 2023/0003030 A1 Jan. 5, 2023

Related U.S. Application Data

(60) Provisional application No. 63/217,816, filed on Jul. 2, 2021.

(51) Int. Cl.
*E04D 15/00* (2006.01)

(52) U.S. Cl.
CPC ..... *E04D 15/003* (2013.01)

(58) Field of Classification Search
CPC ..... E04D 15/003; B25C 11/00; B25C 1/008; E04G 23/006
See application file for complete search history.

(56) References Cited

U.S. PATENT DOCUMENTS 4,663,995 A * 5/1987 Amundson ..... E04D 15/003 30/169
4,691,439 A * 9/1987 Marra ..... E04D 15/003 15/236.05
4,699,430 A * 10/1987 Nichols ..... E04D 15/003 15/93.1
4,763,547 A * 8/1988 Dike, Jr. ..... E04D 15/003 30/169
4,858,503 A * 8/1989 Dike, Jr. ..... E04D 15/003 30/169
5,001,946 A * 3/1991 Shirlin ..... B25B 33/00 30/169
5,741,047 A * 4/1998 Ordonez ..... E04D 15/003 299/37.1
5,800,021 A * 9/1998 Derr ..... E04D 15/003 15/93.1
5,906,145 A * 5/1999 Shepherd ..... E04D 15/003 173/128
6,116,117 A * 9/2000 Nicolosi ..... E04D 15/003 81/45
6,128,979 A * 10/2000 Shepherd ..... E04D 15/003 173/128
6,918,321 B1 * 7/2005 Whittaker ..... E04D 15/003 81/46
7,127,968 B1 * 10/2006 Kriegar ..... E04D 15/003 81/46
7,313,985 B2 * 1/2008 Willis ..... E04D 15/003 81/46
7,373,859 B1 * 5/2008 Shirlin ..... E04D 15/003 30/170

(Continued)

*Primary Examiner* — Michael W Hotchkiss
(74) *Attorney, Agent, or Firm* — Simmons Perrine Moyer Bergman PLC

(57) ABSTRACT

A system and method for removing shingles from a roof with an automatic triggering of power to a fastener engaging member which is accomplished with the aid of relative movement occurring when a leading edge of the system encounters a fastener coupled to a substrate with shingle coupled thereto.

14 Claims, 13 Drawing Sheets

(56) References Cited

U.S. PATENT DOCUMENTS 7,401,861 B2 * 7/2008 Purcell ..... E04D 15/003 15/93.1
7,520,197 B2 * 4/2009 Kingham ..... E04D 15/003 81/463
7,685,909 B1 * 3/2010 Jones ..... E04D 15/003 81/45
8,056,444 B1 * 11/2011 Van Straten ..... E04D 15/003 299/37.1
2002/0053261 A1 * 5/2002 Arturo ..... E04D 15/003 254/131.5
2004/0155087 A1 * 8/2004 Hamlin ..... B27F 7/006 227/110
2005/0120831 A1 * 6/2005 Parker ..... E04D 15/003 81/45
2006/0156866 A1 * 7/2006 Ingell ..... E04D 15/003 81/45
2006/0191378 A1 * 8/2006 Linscott ..... E04D 15/003 81/45
2007/0000354 A1 * 1/2007 Tyler ..... E04D 15/003 81/45
2007/0186728 A1 * 8/2007 Willis ..... E04D 15/003 81/45
2008/0223178 A1 * 9/2008 Creato ..... E04D 15/003 52/748.1
2009/0188350 A1 * 7/2009 Becoat ..... E04D 15/003 81/45
2010/0132515 A1 * 6/2010 Cox ..... E04D 15/003 30/169
2010/0319497 A1 * 12/2010 Creato ..... E04D 15/02 29/426.5
2011/0030511 A1 * 2/2011 Schmidt ..... E04D 15/003 30/170
2012/0096990 A1 * 4/2012 Clifford ..... E04D 15/003 29/426.5
2014/0305263 A1 * 10/2014 Berrian ..... E04D 15/003 81/45
2016/0113186 A1 * 4/2016 Mcafee ..... E04D 15/003 294/51
2019/0345720 A1 * 11/2019 McKinney ..... B66F 15/00
2021/0025171 A1 * 1/2021 Schmaltz ..... E04D 15/003

* cited by examiner

POWER TOOL SYSTEM AND METHOD FOR REMOVING ROOF SHINGLES

CROSS REFERENCE TO RELATED APPLICATIONS

This application claims the benefit of a provisional application filed on Jul. 2, 2021, and having Ser. No. 63/217,816, by the same inventor and entitled "A POWER TOOL FOR REMOVING ROOF SHINGLES" which is hereby incorporated herein in its entirety by this reference.

FIELD OF THE INVENTION

The present invention generally relates to power tools for removing roof shingles.

BACKGROUND OF THE INVENTION

In the past, various tools have been used to remove roof shingles. One of such tools is the Rapid Roof Remover, described at www.rapidroofremover.com. This device uses pneumatic pressure to lift the shingles from the roof deck. Another tool is the Shingle Hog described at www.shinglehog.net. This device operates much like the Rapid Roof Remover except it pivots at a different point.

The Rapid Roof Remover, weighs approximately 50 lbs. The Shingle Hog is lighter, but still about 25 lbs. The weight of these tools is a significant factor affecting their use.

While these tools have enjoyed some success and have been used in the past, they are in need of some improvements.

These mechanisms are so heavy that in some situations their weight makes them difficult to maneuver and to carry onto a roof. The weight of such machines above also prevent their effective use on steep-pitched roofs. The weight of these machines above also increases the risk to the roofer of falling off the roof because the forward momentum of the heavy device can pull the roofer forward and off balance should the front teeth fail to engage with the roof.

Additionally, these use relatively little leverage in their powertrains and consequently have relatively large actuators which fill relatively slowly. The operators often have to wait for the machine to work.

In addition, the lack of an automatic trigger mechanism consistently costs time in having to push the button.

These systems are bulky in size. This factor is similar to weight but independently troublesome. Carrying such systems up a ladder to a rooftop without the help of a second person or the use of some other device(s) would often be difficult and dangerous.

These devices can be dangerous owing to stored energy being continuously supplied to the moving parts, especially in situations when debris gets caught in the mechanism. Such energy supplied to the moving parts could injure the operator when they are trying to remove the debris.

Consequently, there exists a need for improved methods and systems for removing shingles from a roof.

SUMMARY OF THE INVENTION

It is an object of one aspect of the present invention to provide a system of reducing the effort expended and time required to remove shingles from a roof.

It is a feature of one aspect of the present invention to utilize in the actuator a relatively small piston, with a quick charging time. Such an actuator, in combination with a powertrain design with mechanical advantage, can provide ample force for removing shingles.

It is an advantage of the present invention to reduce user initial start-up waiting time.

It is an additional feature of the present invention to provide a lightweight and compact device.

It is an additional advantage of this embodiment of the present invention to provide for ease of use and deployment to a roof in a safe manner.

Accordingly, the present invention is a system for removing shingles from a roof, the system comprising:

- a lower unit 150;
- a lower handle 130;
- a lower handle grip 131 having a lower handle grip longitudinal axis;
- a lower handle shaft 133 having a lower handle shaft longitudinal axis, disposed between and coupled with each of said lower unit 150 and said lower handle 130;
- an upper handle 110;
- an upper handle grip 111 having a upper handle grip longitudinal axis;
- an upper handle shaft 113, having an upper handle shaft longitudinal axis, disposed between and coupled to each of said lower handle 130 and said upper handle 110;
- said lower unit 150 having a lift plate 160 and an actuator 158;
- said lower handle shaft longitudinal axis being substantially colinear with respect to said upper handle shaft longitudinal axis;
- said lower handle grip longitudinal axis and said upper handle grip longitudinal axis being substantially parallel;
- an actuation device 132 responsive to contact between said lift plate 160 and a fastener to be removed; and
- said actuation device 132 being capable of causing said actuator 158 to manipulate said lift plate 160.

A method of removing shingles from a roof comprising the steps of:

- providing a power tool for removing shingles 100;
- moving a leading edge of a lift plate 160 of said power tool for removing shingles 100 under a shingle and into contact with a fastener extending through a shingle and into a substrate;
- said power tool for removing shingles 100 being configured so that said contact automatically causes a powered movement of said lift plate 160 to provide a force on an underside of a portion of a shingle or a fastener, thereby causing a lifting of said shingle or fastener;
- removing said leading edge from said contact;
- terminating lifting of said shingle or fastener; and
- repeating said step of moving a leading edge of a lift plate 160.

Additionally a system for removing shingles from a roof comprising:

- a lower unit 150;
- a lower handle 130;
- a lower handle shaft 133 having a lower handle shaft longitudinal axis; disposed between and coupled with each of said lower unit 150 and said lower handle 130;
- an upper handle 110;
- an upper handle shaft 113, having an upper handle shaft longitudinal axis, disposed between and coupled to each of said lower handle 130 and said upper handle 110;

said lower unit 150 having a lift plate 160 and an actuator 158;

an actuation device 132 responsive to contact between said lift plate 160 and a fastener to be removed; and said actuation device 132 being capable of causing said actuator 158 to manipulate said lift plate 160 when relative movement is detected.

DETAILED DESCRIPTION

Figure 1:
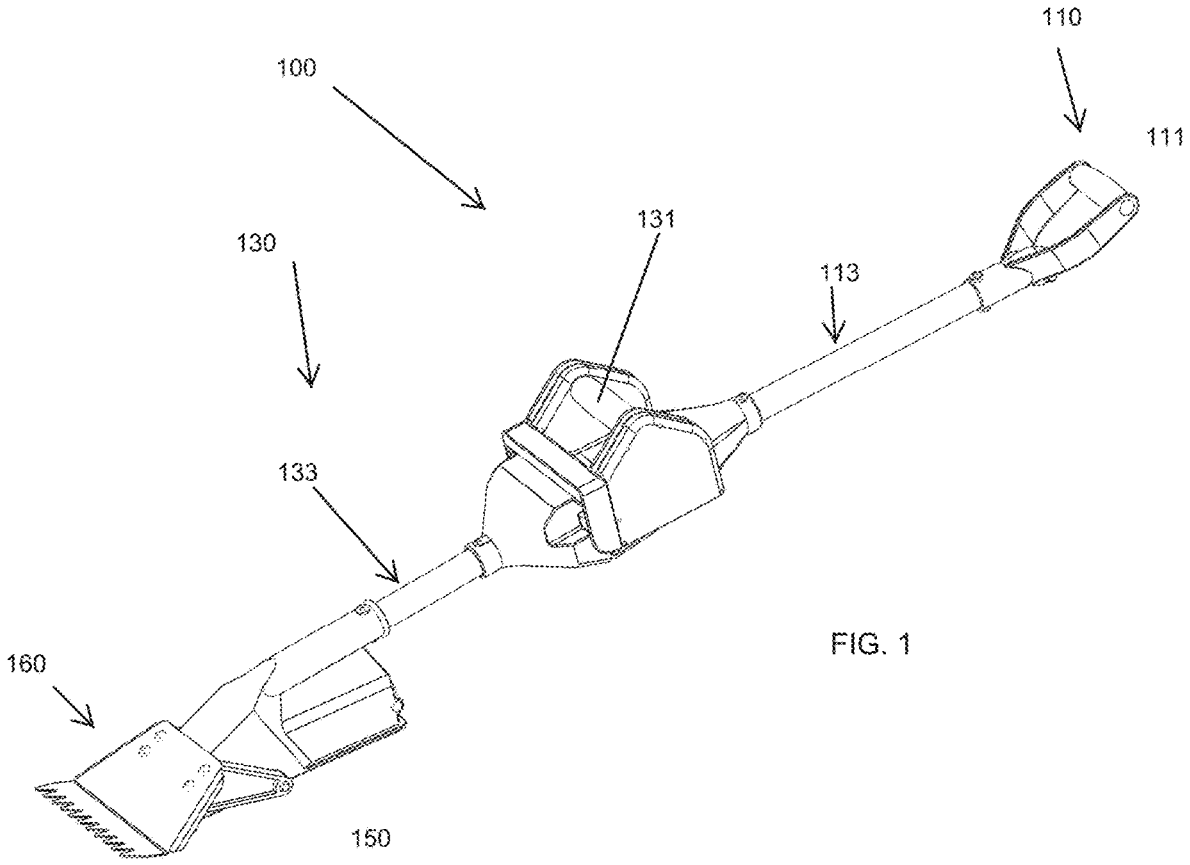
FIG. 1 is a perspective view of a shingle removing tool of the present invention.

Now referring to the drawings wherein like numerals refer to like matter throughout and more particularly referring to FIG. 1, there is shown a perspective view of a power tool for removing shingles, generally designated 100, and including an upper handle portion 110, with upper handle grip 111, a lower handle portion 130 with lower handle grip 131 a lower handle shaft 133, a lift plate 160.

Power tool for removing shingles 100 is shown as a full assembly, where the lower unit 150 contains power generation and transmission mechanisms used to raise the leading edge of the tool, i.e. the saw tooth portion of lift plate 160. Above and to the rear of the lower unit 150 is lower handle 130, this is where the operator holds the power tool for removing shingles 100, with one hand. The lower handle 130 contains the actuation device and the enablement device (both not shown). Above and rearward of the lower handle 130 is upper handle 110.

Figure 2:
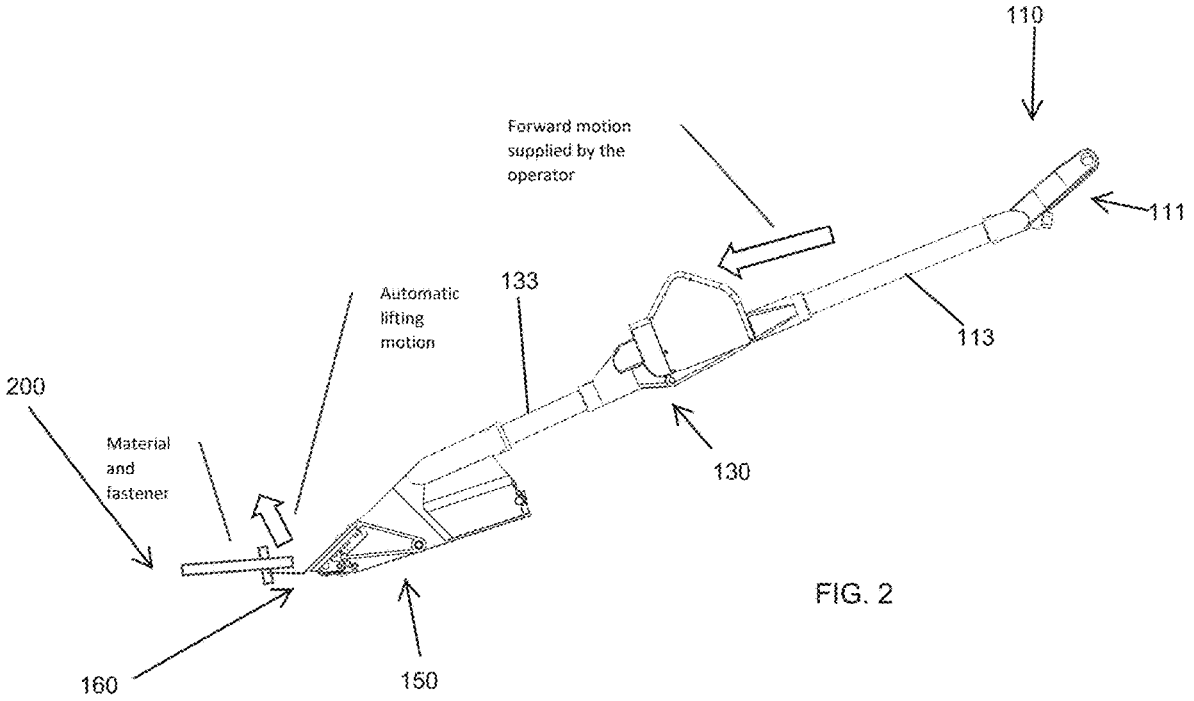
FIG. 2 is a side view of the tool of FIG. 1 with the arrows showing directions of movement to aid in understanding of the operation of the tool.

Now referring to FIG. 2, the tool 100 is used to remove shingle and fastener 200 from a supporting surface (not shown). One example of this would be a roof covered with shingles which are fastened to the roof deck using nails. To operate the machine 100, the operator grasps the tool 100 by the Lower Handle 130 and the Upper Handle 110 and sets the Lower Unit 150 onto the surface. The operator will then place the leading edge of the lift plate 160 under the material to be dislodged from the work surface with a sliding motion. While sliding forward, the leading edge of lift plate 160 will impact one or more fasteners holding the material to the deck. When this occurs, the Lower Unit 150 will be impeded from further forward movement, but the forward motion of the operator will apply additional pressure on the Lower Handle 130 and activate the actuation device plunger (FIG. 14 #1335) in the Lower Handle 130. This causes the machinery within the Lower Unit 150 to raise the leading edge which dislodges the material from the deck. Once the material is dislodged, the leading edge of lift plate 160 automatically lowers to the starting position and the operator repeats the cycle by sliding the machine forward again into the fastened materials.

One advantage of the present invention over the current state of the art is that the design of the power generation and transmission mechanism is more compact and lightweight. This makes the device 100 easier to transport to the work surface, which may be on top of a multi-story building. The low weight and compact size also makes the machine 100 more maneuverable with less energy than the current state of the art.

A second advantage of the present invention over the state of the art is the automatic actuation mechanism. This reduces the time required to operate the machine. From the perspective of the operator, there is no second step required to activate the machine. They simply move the machine into place and the dislodging action occurs without thought or need for further action.

A third advantage to this machine is the additional operator safety provided with the enablement mechanism. The present invention may require the operator to be actively grasping and controlling the machine before it will operate.

This prevents accidental triggering of the automatic actuation mechanism when the operator is not presently engaging the controls.

Now referring to FIG. 2, there is shown a side view of the power tool for removing shingles 100 of FIG. 1. The arrow away from the shingle and fastener 200 shows the direction of motion of the shingle and fastener 200 as the lift plate 160 is actuated upwardly.

Figure 3:
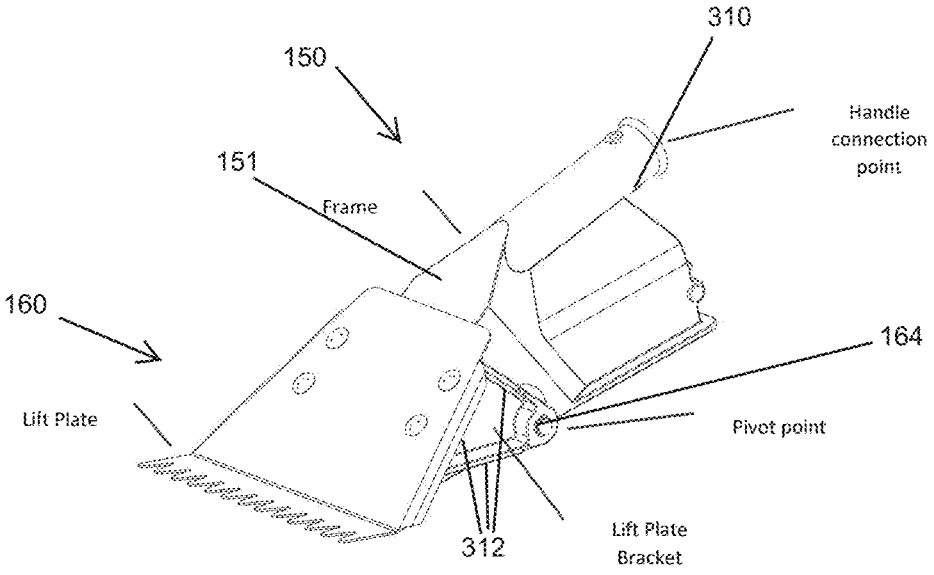
FIG. 3 is close-up perspective view of a portion of the tool of FIG. 1 from above.

Now referring to FIG. 3, there is shown a lower Unit subassembly 150 from above. The lower unit frame 151, lift plate 160 and lift plate bracket 312 can be seen in this view. The Lift Plate Bracket 312 pivotably orients the Lift Plate 160 within reach of the drivetrain components by providing the plate arm pivot shaft 164 for the lift plate bracket 312 and attached lift plate 160 to pivot toward and away from the lower unit frame 151.

Figure 4:
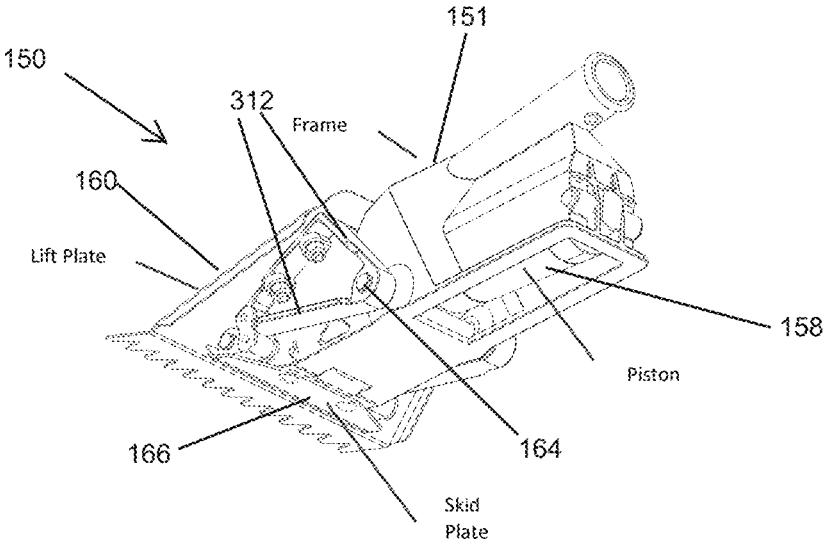
FIG. 4 is an alternate view of portions of the tool of FIG. 3, from below.

Now referring to FIG. 4, there is shown, from below, in addition to some items of FIGS. 1-3, skid plate 166 and a partial view of the actuator/piston 158, which resides within the lower unit frame 151. The Skid Plate 166 is the point of contact that the tool 100 makes with the work surface and should be made of a material that allows the machine to slide freely upon the work surface.

Figure 5:
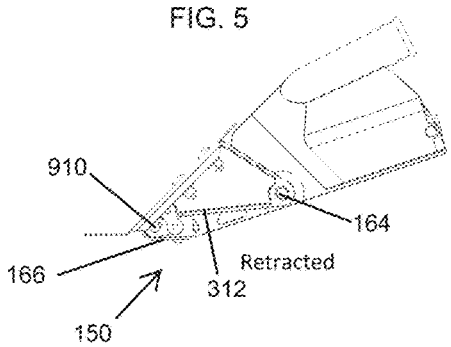
FIG. 5 is a side view of the portion of FIG. 3 where the lift plate is in a retracted or downward orientation.
Figure 6:
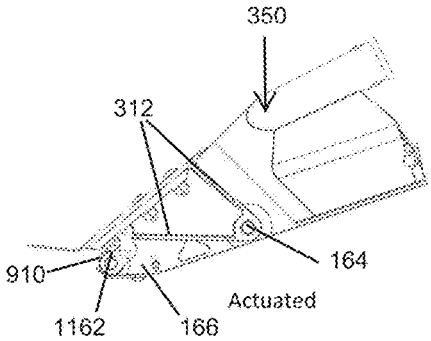
FIG. 6 is a side view of the portion of FIG. 3 where the lift plate is in an actuated or upward orientation.
Figure 7:
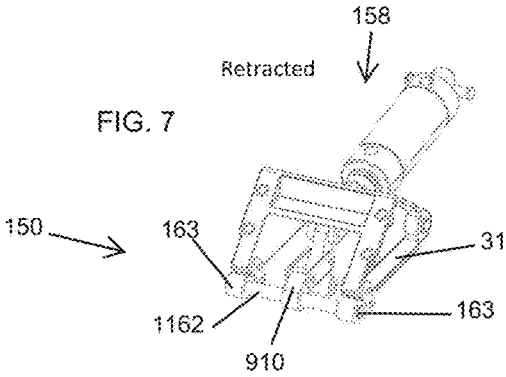
FIG. 7 is a front perspective view of a portion of FIG. 3 in a retracted orientation with the lift plate having been removed from view to expose underlying details.
Figure 8:
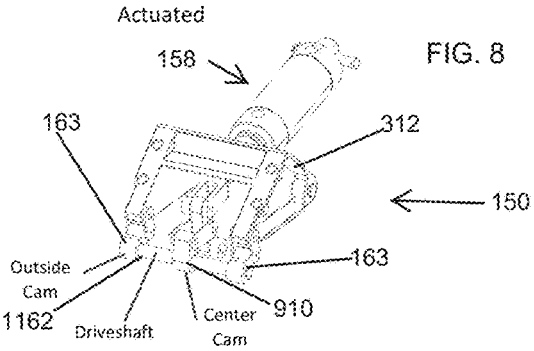
FIG. 8 is a front perspective view of the portion of FIG. 3 in an actuated orientation with the lift plate having been removed to expose underlying details.
Figure 9:
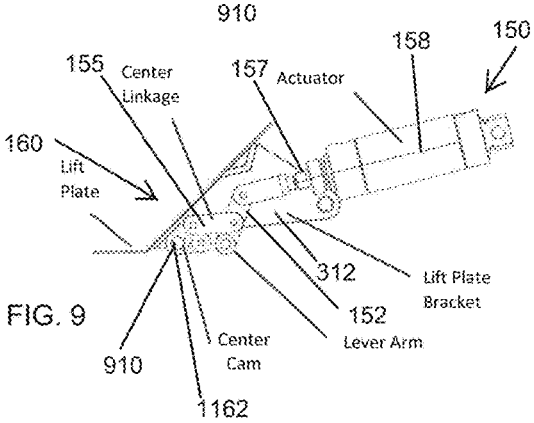
FIG. 9 is a side view of the tool of FIG. 5 with the exterior portions having been omitted from view to expose underlying details.
Figure 10:
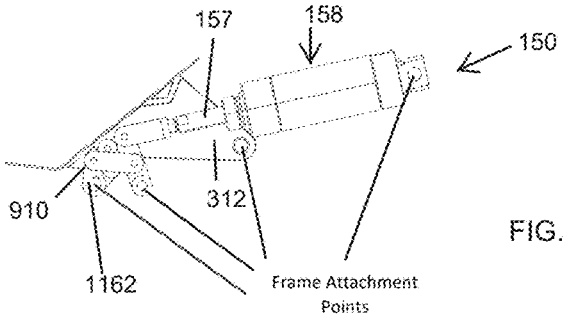
FIG. 10 is a side view of the tool of FIG. 6 with the exterior portions having been omitted from view to expose underlying details.
Figure 11:
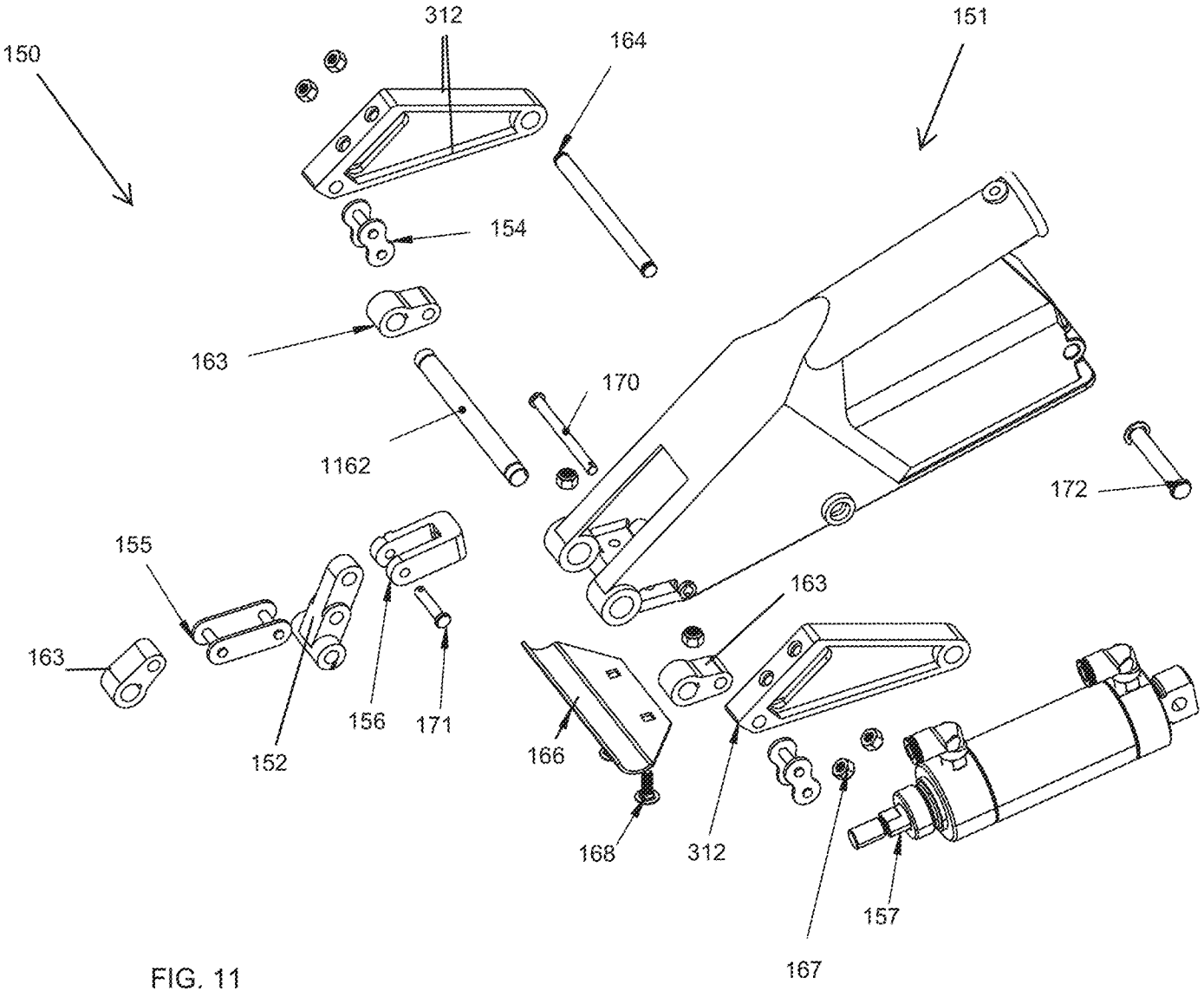
FIG. 11 is an exploded view of the lower unit of FIGS. 3-10.

Now generally referring to FIGS. 5-10, and first specifically to FIGS. 5, 7 and 9, which represent the power tool for removing shingles 100 with some parts omitted from view to show the more internal components of the lower unit 150 while the lift plate 160 is in the retracted orientation. Next referring specifically to FIGS. 6, 8 and 10 which depict actuated orientation The Powertrain within the Lower Unit Assembly 150 are shown with actuator 158, piston assembly 157, lever arm 152, center linkage 155, center cam 910, driveshaft 1162, outside cams 163, and outer linkage 154 (FIG. 11). Together, this system generates the force to actuate the lift plate 160, multiplies the force to obtain more lifting ability, and redirects the force from a predominately horizontal direction to a mostly vertical direction. The Actuator 158 could be a pneumatic cylinder in the primary embodiment, but other embodiments could utilize hydraulic cylinders, electric linear actuators, and combustion cylinders. The actuator 158 is powered in both directions in the primary embodiment and is powered in the direction of actuation but returned to the original position utilizing spring force built into the actuator 158.

The geometry of the components and their attachment points to the lower unit frame 151 combine to provide the mechanical advantage and direction change to the force applied by the actuator 158 within a compact space. A more thorough understanding of the power tool for removing shingles 100 can be aided by now referring to FIG. 11, which is an exploded view of the drive train components of the lower unit 150, note that hoses for transferring working fluids have not been shown in the exploded figures.

Lower Handle Subassembly 130 and Upper Handle 110.

Two embodiments are described below in detail with additional embodiments expressed as part of each discussion. These embodiments all operate off of the same fundamental concept explained above where the forward motion of the operator serves to trigger the actuation event when the extraction plate engages with a fastener.

Figure 12:
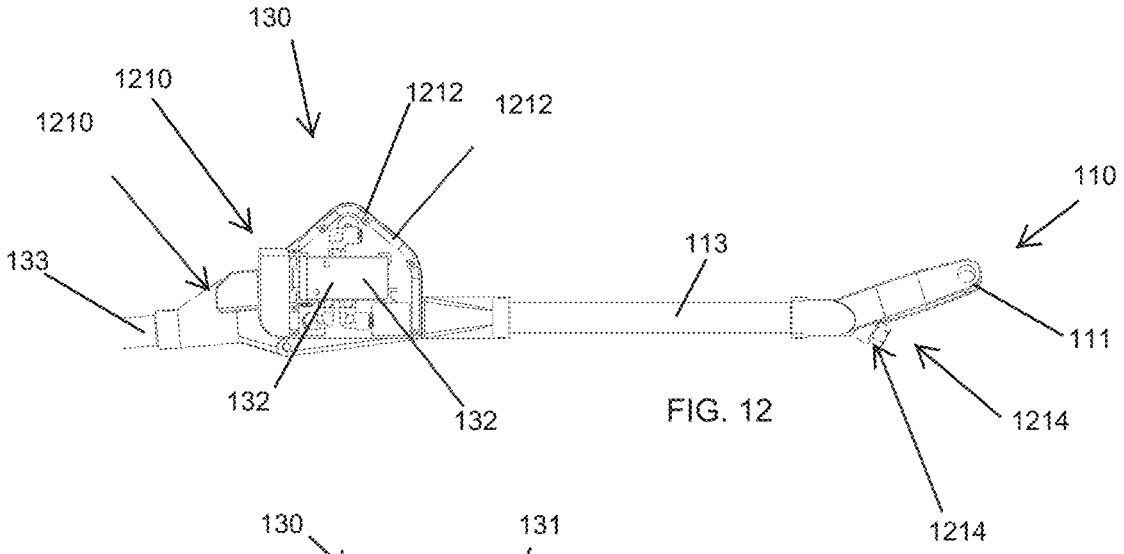
FIG. 12 is a left side view of the handles of FIGS. 1 and 2, with a portion having been removed from view to expose underlying details.
Figure 13:
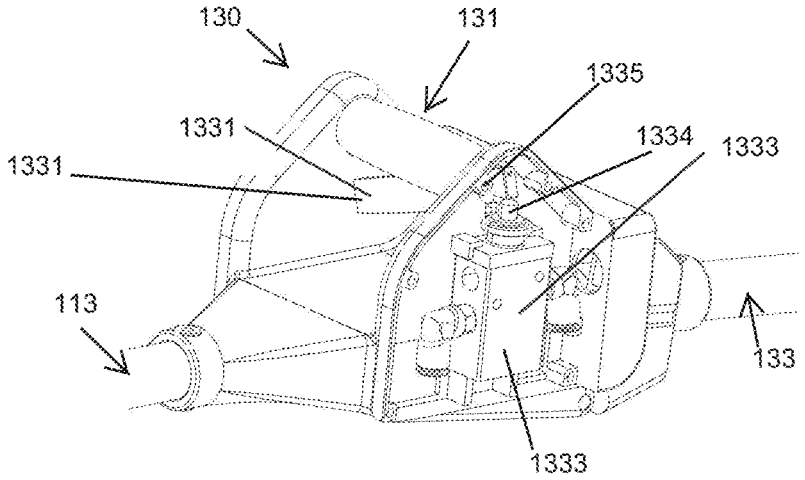
FIG. 13 is a perspective view of the right side of the handle unit of FIGS. 1 and 2, with a portion having been removed from view to expose underlying details.

Now referring to FIGS. 12 and 13, which are the left and right side view of the lower handle 130 of FIGS. 1 and 2, where some exterior portions are omitted from view to expose underlying otherwise internal details.

The Lower Handle subassembly 130 and the Upper Handle 110 provide the operator a place to grasp the device and to control machine enablement and actuation. These subassemblies are connected to the Lower Unit subassembly 150 using the Lower Handle Shaft 133. The Upper handle 110 is connected to the Lower Handle subassembly 130 using the Upper Handle Shaft 113. The Lower Handle Subassembly 130 comprises Lower Housing 1210, the Upper Housing 1212, and the Lower handle 130. The Enablement Lever 1331 is located within the Lower Handle 130. The Enablement Device 1333 is found in the Upper Housing 1212 the Power Supply Connecter 1214 can be found within the Upper Handle 110. Within the Primary Enablement, the Actuation Device 132 is housed within the Upper Housing 1212, in another embodiment (See FIGS. 17-22) the Actuation Device 132 is found within the Lower Housing 1210. See FIG. 2 for an external overview of the assembly and FIGS. 12 and 13 for illustrations of internal components of the primary embodiment.

Tool 100 works by the operator grasping the Lower Handle and therefore pulling the distal end of the Enablement Lever 1331 upward. The proximal end of the Enablement Lever 1331 rotates around the enablement lever pivot point 1335 and pushes on the plunger 1334 to go within the Enablement Device 1333 which triggers the Enablement Device 1333 to supply energy to the Actuation Device 132. This energizes the system and it is ready for an actuation event.

Note that while the primary embodiment of this machine only optionally includes this enablement functionality, other embodiments of this need not include it. The Primary Embodiment is powered with compressed air, thus the enablement device 132 is a pneumatic valve. Other Embodiments utilize pressurized liquids, electricity, or combustion events. The Enablement Device 1331 in such cases is a hydraulic valve, electric switch, and fuel supply valve, respectively.

Actuation is accomplished using the Actuation Device 132 and the relative motion between the Lower Housing 1210 and the Upper Housing 1212 when the operator pushes against the Lower handle and/or the Upper Handle. The operator pushes the machine forward using the Lower Handle 130 and the Upper Handle 110. The machine will slide forward on the Skid Plate 166 until a fastener contacts the leading edge of the Lift Plate 160. The machine will stop moving forward, but the continued forward pressure on the Lower Handle 130 and the Upper Handle will cause the top edge of the Lower Housing 1210 and the Upper Housing 1212 to move towards each other. This motion pushes upon the enablement plunger 1334 built into the actuation device 132, causing it to activate which supplies the compressed air (or pressurized liquid or electricity or combustion gas for hydraulic, electric, or combustion embodiments, respectively) to the drivetrain within the Lower Unit 150. For machine embodiments utilizing an Actuator 158 that is powered in both directions, the Actuation device will supply power to the actuator 158 in the opposite direction to return the machine to its retracted state. This occurs when the operator stops applying forward push on the handles or when the enablement lever 1331 is released.

Figure 14:
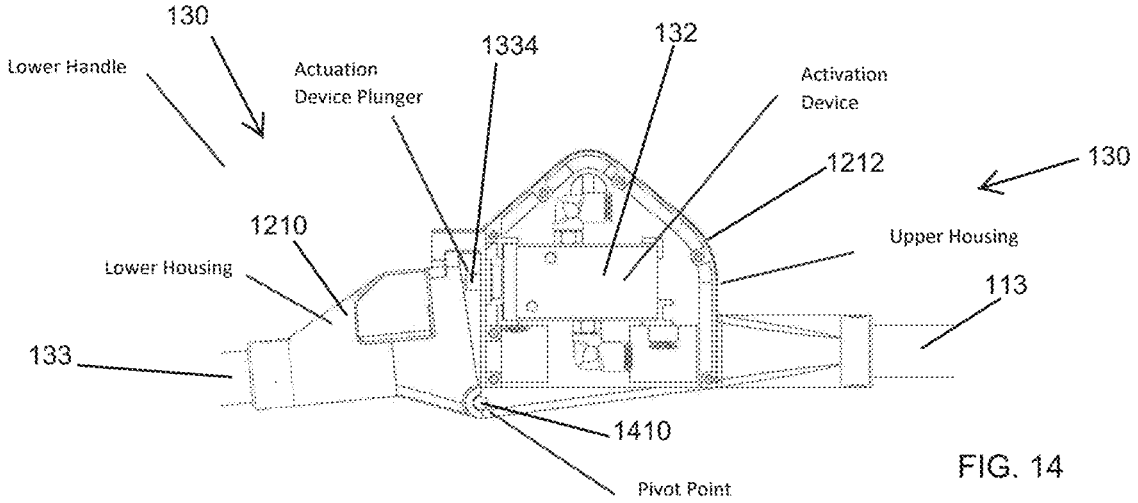
FIG. 14 is a close up left side view of the handles of FIGS. 1 and 2, with a portion having been removed from view to expose underlying details, when the lower and upper housings of the tool are in a non-actuated orientation.
Figure 15:
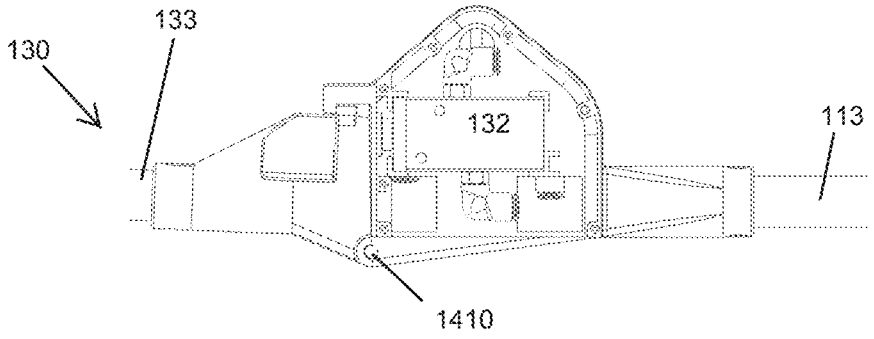
FIG. 15 is a close up left side view of the handles of FIGS. 1 and 2, with a portion having been removed from view to expose underlying details, when the lower and upper housings of the tool are in an actuated orientation.

Now referring to FIGS. 14 and 15 in the primary embodiment, the motion between the lower housing 1210 and the upper housing 1212 is rotational around the pivot point 1410 where the housings are attached to each other. Other embodiments use linear motion along shafts connecting the housings.

As discussed above, various different types of power sources could be utilized in the present invention depending upon the specific application (e.g. pneumatic, hydraulic, electrical, and/or mechanical). In each of these specific applications, the activation energy is only supplied to the Activation Device 132 when tool 100 has been enabled using the enablement device 1331. The source of power is provided from the Power Supply Connector to the enablement device 1333, then to the actuation device 132, and finally to the Lower Unit drivetrain using hoses or wires, which are not pictured in the diagrams for clarity.

Figure 16:
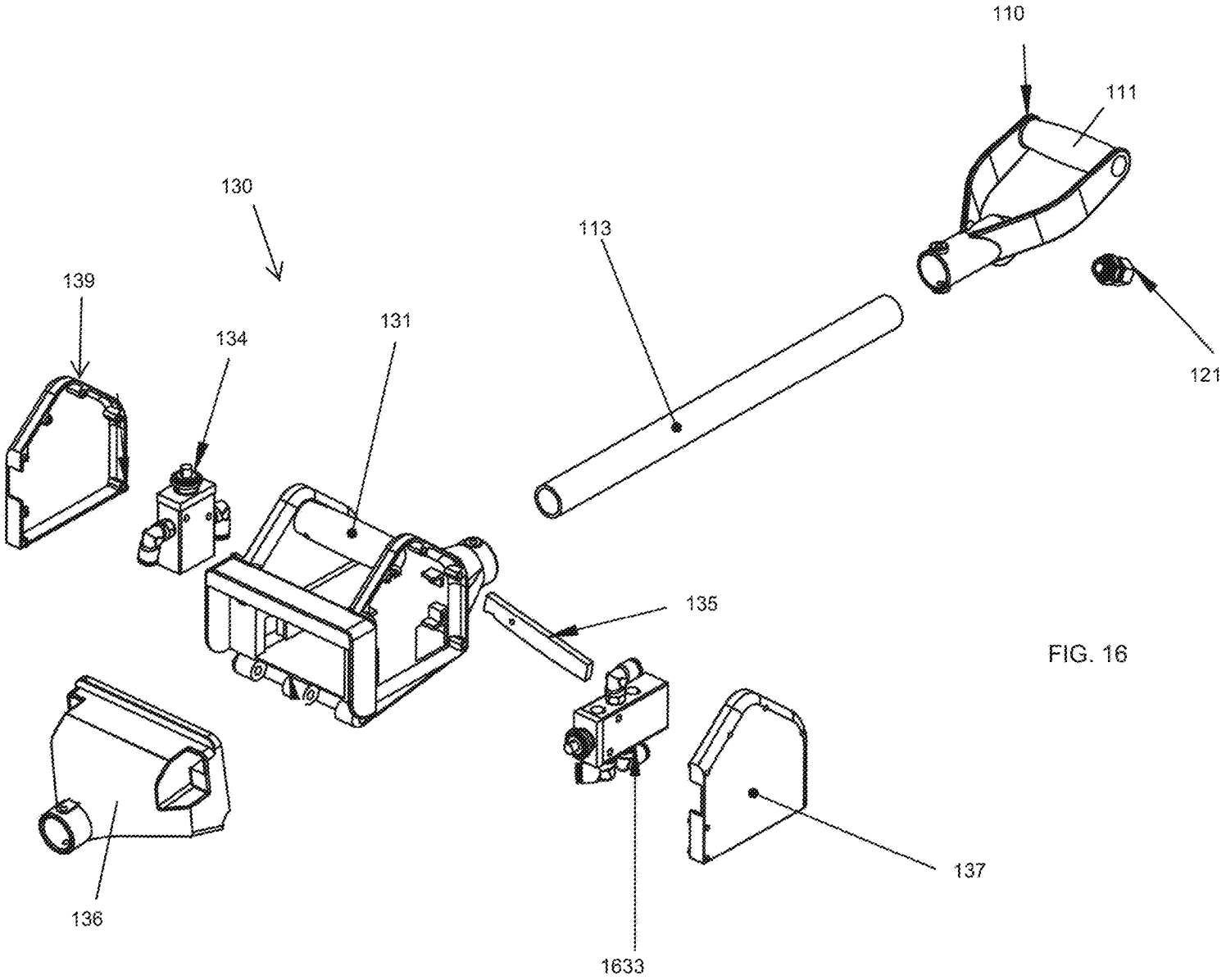
FIG. 16 is an exploded view of the handle unit of FIGS. 12-15.

The above-described features may be better understood by referring to FIG. 16, which is an exploded view of the actuation and enablement features of the present invention. These above-described configurations are believed to possibly be preferred. However, it is understood that the following alternate embodiment could be beneficial in some situations.

1. Other apparatuses could be made to be wider or narrower.
2. They could be made to be more powerful with a bigger piston or with larger lever arms in the drivetrain.
3. They might come up with a different angle or adjustable angle for the leading edge of the tool.
4. They might move the pivot points of the various levers.
5. They might put wheels or rollers on it.
6. They might have the lift plate brackets within a frame.
7. They could change the angle that the handle exits the lower unit.
8. The actuation mechanism could be done in a number of ways.

Figure 17:
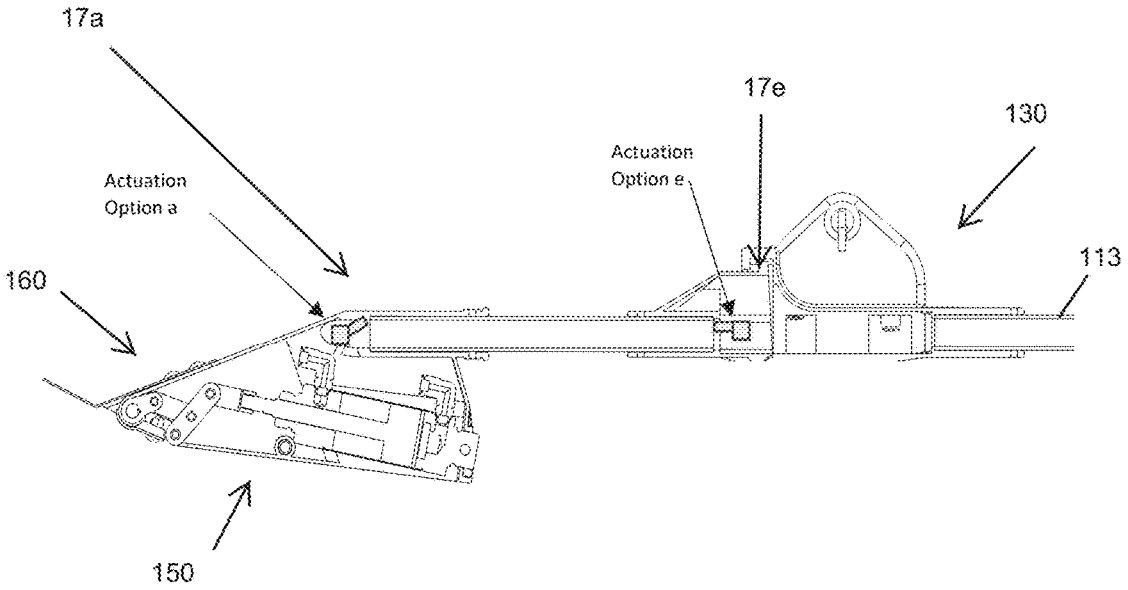
FIG. 17 is a view of an embodiment of the present invention with components for alternate actuation options a and e.

Now referring to FIG. 17, the handle could slide back and forth within the entry point to the lower unit and trigger a switch with the sliding motion. Also in FIG. 17 is an embodiment where the lower handle slides into the handle assembly and causes activation from the sliding motion. This occurs at 17*e*.

Figure 18:
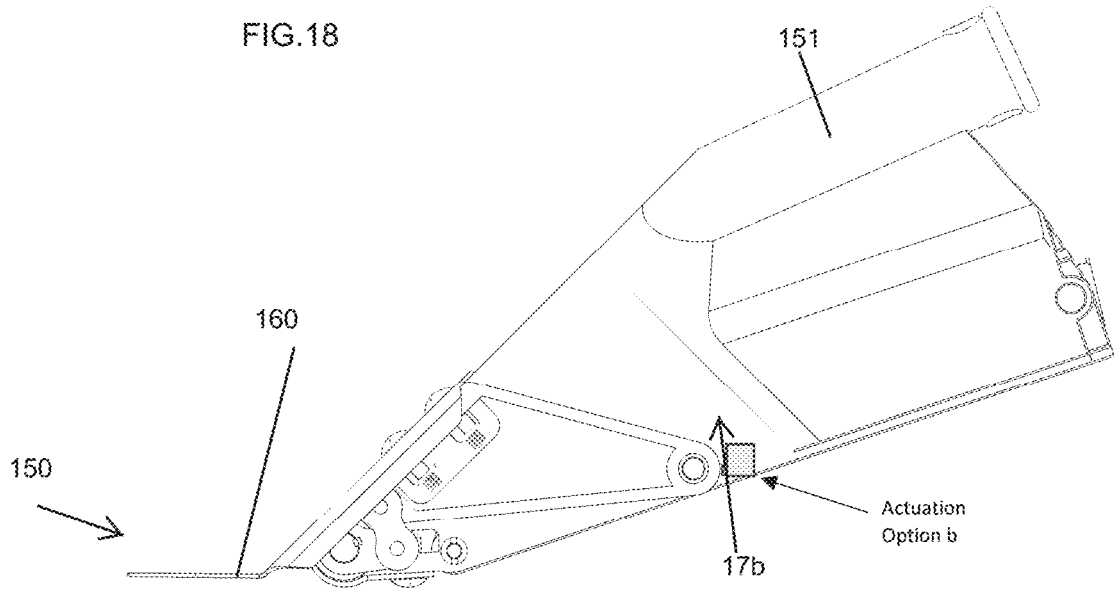
FIG. 18 is a view of an embodiment of the present invention with components for alternate actuation option b.

Now referring to FIG. 18, it should be understood that there could be a sliding mechanism built into the hinge of the lift plate where the impact of the nail hitting the lift plate fires the tool 100 using the triggering device at 17*b*.

Figure 19:
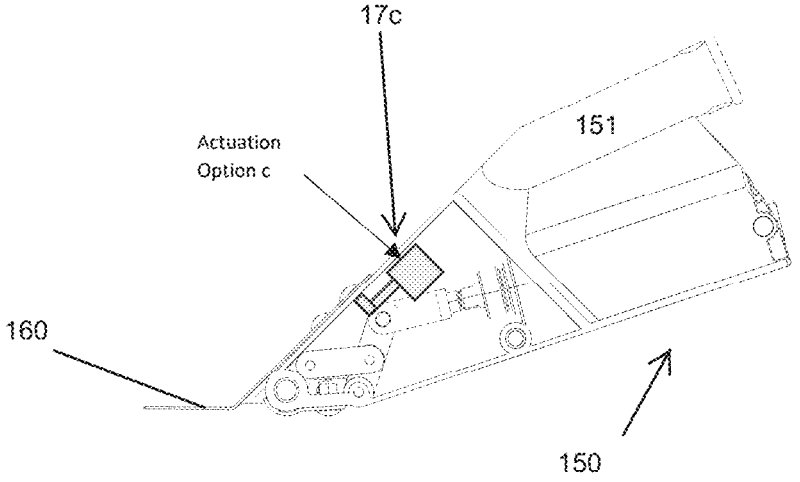
FIG. 19 is a view of an embodiment of the present invention with components for alternate actuation options c.

Now referring to FIG. 19, the resting position of the lift plate could be actuated slightly. This would cause the trigger action by compressing the lift plate downward.

Figure 20:
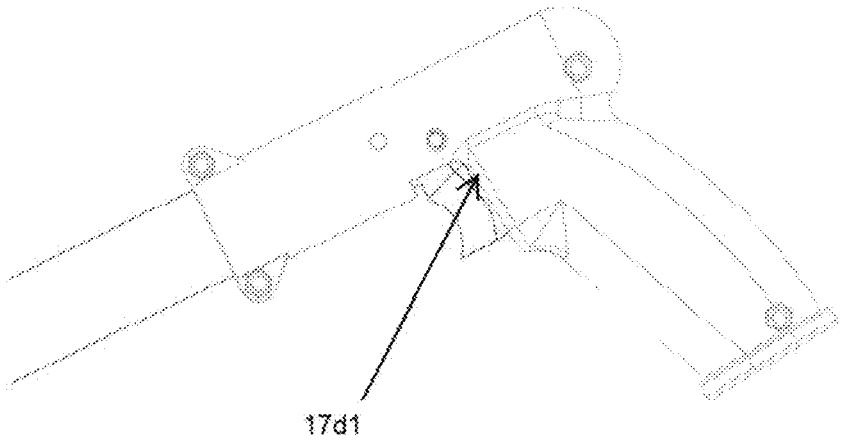
FIG. 20 is a view of a first alternate upper handle embodiment of the present invention with components for alternate actuation option d.
Figure 21:
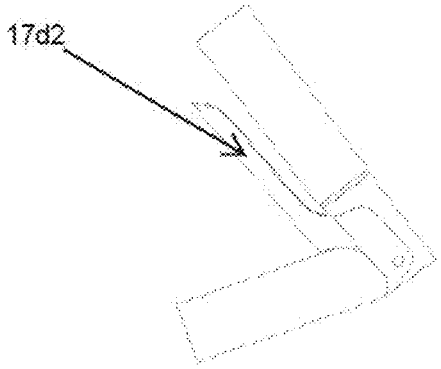
FIG. 21 is a view of a second alternate upper handle embodiment of the present invention with components for alternate actuation option d.

Now referring to FIGS. 20 and 21, the automatic triggering could be omitted and a manual trigger could be placed into either one of the handles.

There is shown in FIG. 20 first Actuation Option d.

Actuation device within a manual trigger.

Alternatively, this manual trigger at 17*d*1 or 17*d*2 could be used to activate the enablement device and the actuation could occur as discussed with the primary and alternative embodiments discussed above. Shown in FIG. 21 is a second alternate upper handle embodiment with:

Actuation Option d.

Actuation device within a manual trigger.

The enablement device is activated by this manual trigger within the upper handle.

Figure 22:
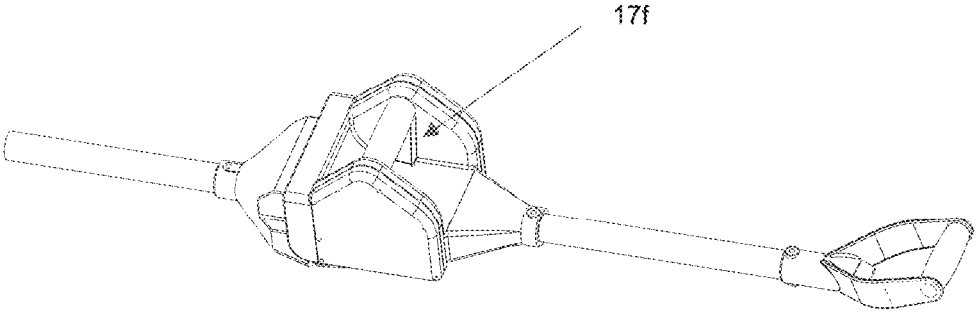
FIG. 22 is a view of an embodiment of the present invention with components for alternate actuation option f.

Now referring to FIG. 22, there could be a sliding mechanism in the lower handle assembly instead of the rotating action that this device uses.

The lower handle could pivot without the upper handle shaft having to rotate with it causing the upper housing to slide into the lower housing, causing the plunger on the actuation device to be pressed without the need for rotation.

Actuation Option f Lower handle moves forward without upper handle motion moving forward upon sides built into the upper housing.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A system for removing a shingle from a roof, the system comprising:

a lower unit;

a lower handle;

a lower handle grip having a lower handle grip longitudinal axis;

a lower handle shaft having a lower handle shaft longitudinal axis, disposed between and coupled with each of said lower unit and said lower handle;

an upper handle;

an upper handle grip having an upper handle grip longitudinal axis;

an upper handle shaft, having an upper handle shaft longitudinal axis, disposed between and coupled to each of said lower handle and said upper handle;

said lower unit having a lift plate and an actuator, with a piston and a series of pivotally coupled rigid members including a lever arm connected to said piston and an outer cam connected to said lever arm via a center linkage component, each of the lever arm and outside cam configured to provide a mechanical advantage, disposed between said lift plate and said actuator, so that a displacement of the piston out of said actuator results in a first pushing force being transmitted from said actuator to said piston, a second pushing force being transmitted through said series of pivotally coupled rigid members, results in twice multiplying said first pushing force; to a resultant third pushing force between said lift plate and said shingle;

said lower handle shaft longitudinal axis being substantially colinear with respect to said upper handle shaft longitudinal axis;

said lower handle grip longitudinal axis and said upper handle grip longitudinal axis being substantially parallel;

an actuation device responsive to contact between said lift plate and a fastener to be removed;

said actuation device being capable of causing said actuator to manipulate said lift plate;

wherein said actuator comprises a pneumatic piston;

wherein said actuation device is a pneumatic valve coupled to said pneumatic piston; wherein said upper handle grip comprises a pneumatic push to connect connector;

wherein said pneumatic push to connect connector is in fluid communication with actuator;

wherein fluid communication between said pneumatic push to connect connector and said actuator is dependent upon a deployment configuration of an enablement lever and enablement plunger;

wherein said fluid communication is further dependent upon said actuation device; and wherein actuation device is coupled to an actuation plunger.

2. A system for removing a shingle from a roof comprising:

a lower unit;

a lower handle;

a lower handle shaft having a lower handle shaft longitudinal axis; disposed between and coupled with each of said lower unit and said lower handle;

an upper handle;

an upper handle shaft, having an upper handle shaft longitudinal axis, disposed between and coupled to each of said lower handle and said upper handle;

said lower unit having a lift plate and an actuator, with a piston and a series of pivotally coupled rigid members including a lever arm connected to said piston and an outer cam connected to said lever arm via a center linkage component, each of the lever arm and outside cam configured to provide a mechanical advantage, disposed between said lift plate and said actuator, so that a displacement of the piston out of said actuator results in a first pushing force being transmitted from said actuator to said piston, a second pushing force being transmitted through said series of pivotally coupled rigid members, results in twice multiplying said first pushing force; to a resultant third pushing force between said lift plate and said shingle;

an actuation device responsive to contact between said lift plate and a fastener to be removed; and said actuation device being capable of causing said actuator to manipulate said lift plate when relative movement is detected.

3. The system of claim 2 wherein said relative movement is detected between a lift plate bracket and a lower unit frame.

4. The system of claim 2 wherein said relative movement is detected between said lower unit and said lower handle shaft.

5. The system of claim 2 wherein said relative movement is detected between said lower handle shaft and a lower housing.

6. The system of claim 2 wherein said relative movement is detected between a first portion of a first upper hand engagement area and a second portion of the first upper hand engagement area.

7. The system of claim 6 wherein said first portion of said first upper hand engagement area is a trigger interface for engagement by a finger, and said second upper hand engagement area of said portion of the first upper hand engagement area is a first location stationary with respect to said upper handle shaft.

8. A system for removing a shingle from a roof, the system comprising:

a lower unit, a lower handle;

a lower handle grip having a lower handle grip longitudinal axis;

a lower handle shaft having a lower handle shaft longitudinal axis, disposed between and coupled with each of said lower unit and said lower handle;

an upper handle;

an upper handle grip having an upper handle grip longitudinal axis;

an upper handle shaft, having an upper handle shaft longitudinal axis, disposed between and coupled to each of said lower handle and said upper handle;

said lower unit having a lift plate and an actuator, with a piston and a series of pivotally coupled rigid members, including a lever arm connected to said piston and an outer cam connected to said lever arm via a center linkage component, each of the lever arm and outside cam configured to provide a mechanical advantage, disposed between said lift plate and said actuator, so that a displacement of the piston out of said actuator results in a first pushing force being transmitted from said actuator to said piston, a second pushing force being transmitted through said series of pivotally coupled rigid members, results in twice multiplying said first pushing force; to a resultant third pushing force between said lift plate and said shingle;

said lower handle shaft longitudinal axis being substantially colinear with respect to said upper handle shaft longitudinal axis;

said lower handle grip longitudinal axis and said upper handle grip longitudinal axis being substantially parallel;

an actuation device responsive to contact between said lift plate and a fastener to be removed;

said actuation device being capable of causing said actuator through said first pushing force and said second pushing force to manipulate said lift plate so as to tend to separate said shingle from said roof; and wherein said actuator comprises a pneumatic piston.

9. The system of claim 8 wherein said actuation device is a pneumatic valve coupled to said pneumatic piston.

10. The system of claim 9 wherein said upper handle grip comprises a pneumatic push to connect connector.

11. The system of claim 10 wherein said pneumatic push to connect connector is in fluid communication with said actuator.

12. The system of claim 11 wherein fluid communication between said pneumatic push to connect connector and said actuator is dependent upon a deployment configuration of an enablement lever and enablement plunger.

13. The system of claim 12 wherein said fluid communication is further dependent upon said actuation device.

14. The system of claim 13 wherein said actuation device is coupled to an actuation plunger.

* * * * *